US011821234B2

(12) United States Patent
Hsu et al.

(10) Patent No.: US 11,821,234 B2
(45) Date of Patent: Nov. 21, 2023

(54) SEISMIC ISOLATION DEVICE

(71) Applicant: NATIONAL TAIWAN UNIVERSITY OF SCIENCE AND TECHNOLOGY, Taipei (TW)

(72) Inventors: Ting-Yu Hsu, Taipei (TW); Shiang-Jung Wang, Taipei (TW)

(73) Assignee: NATIONAL TAIWAN UNIVERSITY OF SCIENCE AND TECHNOLOGY, Taipei (TW)

( * ) Notice: Subject to any disclaimer, the term of this patent is extended or adjusted under 35 U.S.C. 154(b) by 0 days.

(21) Appl. No.: 17/584,451

(22) Filed: Jan. 26, 2022

(65) Prior Publication Data

US 2022/0251863 A1 Aug. 11, 2022

(30) Foreign Application Priority Data

Feb. 9, 2021 (TW) ..... 110105077

(51) Int. Cl.
*E04H 9/02* (2006.01)

(52) U.S. Cl.
CPC ..... *E04H 9/023* (2013.01)

(58) Field of Classification Search
CPC ..... E04H 9/023; E04H 9/021; E04H 9/0215; E04H 9/0235; E04H 9/0237; E04H 9/028; E04H 3/029; E04B 1/98; E04B 1/36; E02D 31/08; E02D 27/34; F16F 15/022; F16F 15/02; F16F 15/03
See application file for complete search history.

(56) References Cited

U.S. PATENT DOCUMENTS 4,462,955 A * 7/1984 Albin ..... E04B 1/36 52/167.6
5,245,807 A * 9/1993 Ishimaru ..... E02D 27/34 52/167.2
8,056,914 B2 * 11/2011 Kalil ..... B60B 19/06 301/5.1
11,136,778 B1 * 10/2021 Ray ..... E04H 9/0215
2006/0048462 A1 * 3/2006 Huang ..... E04H 9/023 52/167.5

(Continued)

OTHER PUBLICATIONS

Malaga-Chuquitaype et al., Experimental and Numerical Assessment of the Seismic Response of Steel Structures with Clutched Inerters, Soil Dynamics and Earthquake Engineering vol. 121, p. 200-211, Jun. 2019, (obtained from https://www.sciencedirect.com/science/article/pii/S0267726118305001) (Year: 2019).*

(Continued)

*Primary Examiner* — Theodore V Adamos
(74) *Attorney, Agent, or Firm* — BACON&THOMAS,PLLC

(57) ABSTRACT

A seismic isolation device comprises an isolation support and an inerter unit arranged on the side of the isolation support, the isolation support having an upper plate and a lower plate, the inerter unit having a rotating rod extending to the side of the lower plate and a flywheel linked with the rotating rod, wherein when the upper and lower plates of the present invention undergo relative displacement due to the occurrence of an earthquake, the inerter unit provide an inertance to reduce the displacement reaction, thereby providing better seismic isolation effect.

13 Claims, 11 Drawing Sheets

(56) References Cited

U.S. PATENT DOCUMENTS

| | | | | |
|---|---|---|---|---|
| 2008/0098671 | A1* | 5/2008 | Tsai | E04H 9/023 52/167.6 |
| 2012/0124920 | A1* | 5/2012 | Alsaif | E04H 9/0235 52/741.3 |
| 2018/0252287 | A1* | 9/2018 | Mitsch | F16F 7/1022 |
| 2022/0163094 | A1* | 5/2022 | Sun | F16F 15/1333 |

OTHER PUBLICATIONS

Madhamshetty et al., Low-Rate Characterization of a Mechanical Inerter, Jul. 18, 2018 (obtained from https://www.mdpi.com/2075-1702/6/3/32) (Year: 2018).*

Pietrosanti et al., Experimental Seismic Performance Assessment and Numerical Modelling of Nonlinear Inerter Vibration Absorber (IVA)-Equipped Base Isolated Structures Tested on Shaking Table, Earthquake Engineering & Structural Dynamics, Apr. 2021 (Year: 2021).*

* cited by examiner

SEISMIC ISOLATION DEVICE

BACKGROUND OF THE INVENTION

(1) Field of the Invention

The present invention relates to a seismic isolation device, in particular to a seismic isolation device with inerter.

(2) Description of the Prior Art

An earthquake often leads to many losses of immovable or movable properties, such as cracks and tilts of buildings, overturned decorations, damage to precision instruments and equipment, and even cause casualties.

In order to reduce the losses associated with earthquakes, a sloped rolling-type isolator (hereinafter referred to as SRI) has appeared on the market, which is used to carry the immovable or movable properties, so as to reduce the impact of lateral force resulting from earthquakes. The main advantage of the SRI is that it can greatly reduce the transmission acceleration to make it close to a stable value, and it is not easy to resonate with the disturbance resulting from earthquakes. The SRI also has a good self-reset ability to restore itself to its initial state after earthquakes.

However, when the traditional SRI is subject to an earthquake with velocity pulse, its displacement reaction may be too large, causing the internal elements of the SRI to collide with each other. In other words, when the SRI is subject to a large surface acceleration generated by a large earthquake, the maximum displacement reaction of the SRI will easily exceed its design range to cause a collision, to result in damage to the equipment.

In order to avoid the aforementioned problems, known technology is to increase the built-in sliding friction damping in the traditional SRI, to suppress the displacement reaction caused by the seismic lateral force. However, the known technology may not avoid the excessive acceleration reaction transmitted up via the SRI, and may cause the residual displacement after the earthquake.

In another conventional technology, a tuned mass damper (hereinafter referred to as TMD) is installed on a building. The TMD includes mass blocks, springs and damping systems. Generally, the TMD is supported or suspended on the building according to the differences of building structures to transfer the vibration energy from the building to the TMD, to reduce the vibration of the building. However, the traditional TMD must rely on massive mass blocks to achieve its vibration damping effect. The mass of the mass blocks is up to several percentages of the overall building, so they are expensive to manufacture and may occupy huge interior space, such as the 101 building. In addition, water/ice storage tanks may be used as the mass blocks.

Therefore, how to overcome the various deficiencies of the conventional technologies has become an urgent problem to be solved at present.

SUMMARY OF THE INVENTION

One object of the present invention is to provide a seismic isolation device, to not only improve the problems about too large displacement reaction of the traditional SRI and the massive mass block of the traditional TMD, but also balance the acceleration reaction and displacement reaction.

In order to achieve the aforementioned object, the present invention provides a seismic isolation device including an isolation support and an inerter unit. The isolation support includes an upper plate and a lower plate. The inerter unit includes a rotating rod and a flywheel. The rotating rod is arranged on a side of the upper plate and has an upper end and a lower end. The lower end of the rotating rod extends to a side of the lower plate, and the upper end of the rotating rod is linked with the flywheel. The inerter unit provide an inertance, which is the ratio of the inertial force generated by the inerter unit to the relative acceleration between the upper plate and the lower plate, to reduce a displacement reaction resulted from relative displacement between the upper and lower plates.

In an embodiment, the inerter unit comprises a pinion disposed at the lower end of the rotating rod, and the isolation support comprises a rack disposed at the side of the lower plate to mesh with the pinion.

In an embodiment, the isolation support comprises a bearing disposed the side of the upper plate, and a mounting bracket for fixing the bearing to the side of the upper plate, so that the rotating rod may penetrate the bearing.

In an embodiment, the inerter unit comprises a gear assembly and an electromagnetic damper, wherein the gear assembly is linked with the electromagnetic damper through the rotating rod, and the electromagnetic damper is linked with the flywheel through the rotating rod.

In an embodiment, the gear assembly is a speed-change gear, and the electromagnetic damper is a motor for power generation.

In an embodiment, the isolation support comprises at least one roller located between the upper and lower plates.

In an embodiment, the lower plate comprises an upper surface with a lower reset ditch, and the upper plate comprises a lower surface with an upper reset ditch corresponding to the lower reset ditch, wherein the at least one roller is located between the upper reset ditch and lower reset ditch.

In an embodiment, the lower reset ditch is a V-shaped ditch, and the upper reset ditch is an upside down V-shaped ditch.

In an embodiment, the isolation support comprises a top plate disposed on the upper plate, and at least one second roller disposed between the top plate and the upper plate.

In an embodiment, the seismic isolation device further comprises a second inerter unit disposed a second side of the upper plate together with a side of the top plate, to provide a second inertance to reduce a displacement reaction resulted from relative displacement between the top and upper plates, wherein the relative displacement between the top and upper plates has a direction different from that of the relative displacement between the upper and lower plates.

In an embodiment, the flywheel has a mechanism with varying inerter, and the mechanism with varying inerter provides different magnitude of the inertance as the rotation speed of the rotating rod changes.

In an embodiment, the mechanism with varying inerter includes two guide rods, two mass blocks and two springs, one end of each of the two guide rods is fixed to the rotating rod, the two springs are respectively sleeved on the two guide rods, and the two guide rods respectively pass through the two mass blocks, each of the mass two blocks is correspondingly connected to one end of each of the springs.

In an embodiment, the other end of each of the guide rods has a baffle, and the other end of each of the two springs is selectively fixed to one of the rotating rod and the baffle.

In an embodiment, the lower plate of the isolation support is disposed on a floor slab of a building, and the upper plate has an upper surface to disposed an elevated floor thereon.

In an embodiment, the number of the inerter unit is at least two, including a first inerter unit and a second inerter unit, both of which are arranged on the same side of the isolation support, wherein the first inerter unit includes a first clutch and a first flywheel, the second inerter unit includes a second clutch and a second flywheel, wherein when the upper plate moves in a first direction relative to the lower plate, the first clutch drives the first flywheel to rotate counterclockwise while the second flywheel is stationary, wherein when the upper plate moves in a second direction relative to the lower plate, the second clutch drives the second flywheel to rotate clockwise while the first flywheel is stationary.

From the above, the seismic isolation device of the present invention drives the rotating rod of the inerter unit by the relative displacement generated between the upper plate and the lower plate of the isolation support, to make the flywheel rotate with the rotating rod. Thereby, the inerter unit provides the inertance to reduce the response degree of the relative displacement between the upper plate and the lower plate, so a better seismic isolation effect is provided by avoiding the impact of collision generated inside the isolation support. In addition, the seismic isolation device of the present invention includes a top plate and a second inerter unit, so the response degree of relative displacement in different directions may be reduced. By adding the mechanism with varying inerter into the seismic isolation device, the inerter unit can be controlled to greatly increase the inertance as the response of the seismic isolation device gets larger, so that the displacement and speed reactions of the seismic isolation device are greatly reduced, and the acceleration reaction is still maintained less than that of no installation of the seismic isolation device.

DESCRIPTION OF THE PREFERRED EMBODIMENTS

In the following the details of preferred embodiments accompanied by their corresponding drawings clearly explain the early statements on this invention and other technical contents, features, and functions.

In this regard, the direction-related terms, such as "top," "bottom," "left," "right," "front," "back," etc., are used with reference to the orientations of the objects in the Figure(s) being considered. The components of the present invention can be positioned in a number of different orientations. As such, the direction-related terms are used for the purposes of illustration and by no means as restrictions to the present invention. On the other hand, the sizes of the objects in the schematic drawings may be overstated for the purpose of clarity. It is to be understood that other likely-employed embodiments or possible changes made in the structure of the present invention should not depart from the scope of the present invention. Also, it is to be understood that the phraseology and the terminology used herein are for the purpose of description and should not be regarded as limits to the present invention. The use of "including," "comprising," or "having" and variations thereof herein is meant to cover the items listed thereafter and equivalents thereof as well as additional items. Unless otherwise stated, the terms "connected," "coupled," and "mounted" and variations thereof herein are used in a broad sense and cover direct and indirect connections, couplings, and mountings. Similarly, the terms "facing," "faces" and variations thereof herein are used in a broad sense and cover direct and indirect facing, and the term "adjacent to" and variations thereof herein is used in a broad sense and cover directly and indirectly "adjacent to". Therefore, the description of "A" component facing "B" component herein may include the situations that "A" component facing "B" component directly or one or more additional components between "A" component and "B" component. Also, the description of "A" component "adjacent to" "B" component herein may include the situations that "A" component is directly "adjacent to" "B" component or one or more additional components between "A" component and "B" component. Accordingly, the drawings and the descriptions will be regarded as illustrative in nature, but not restrictive.

Figure 1:
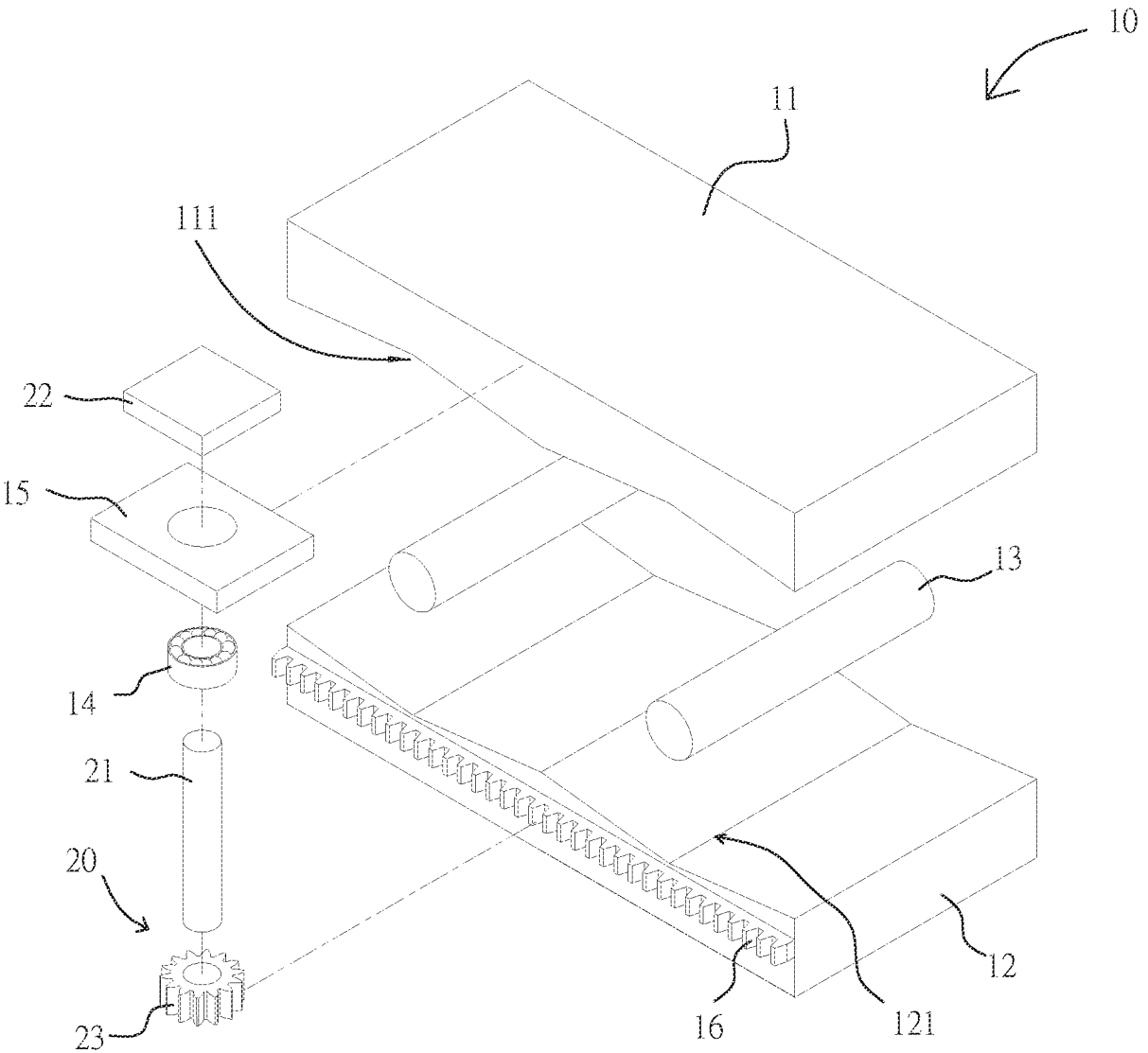
FIG. 1 is an exploded view showing the three-dimensional structure of the first embodiment of the seismic isolation device according to the present invention.
Figure 2:
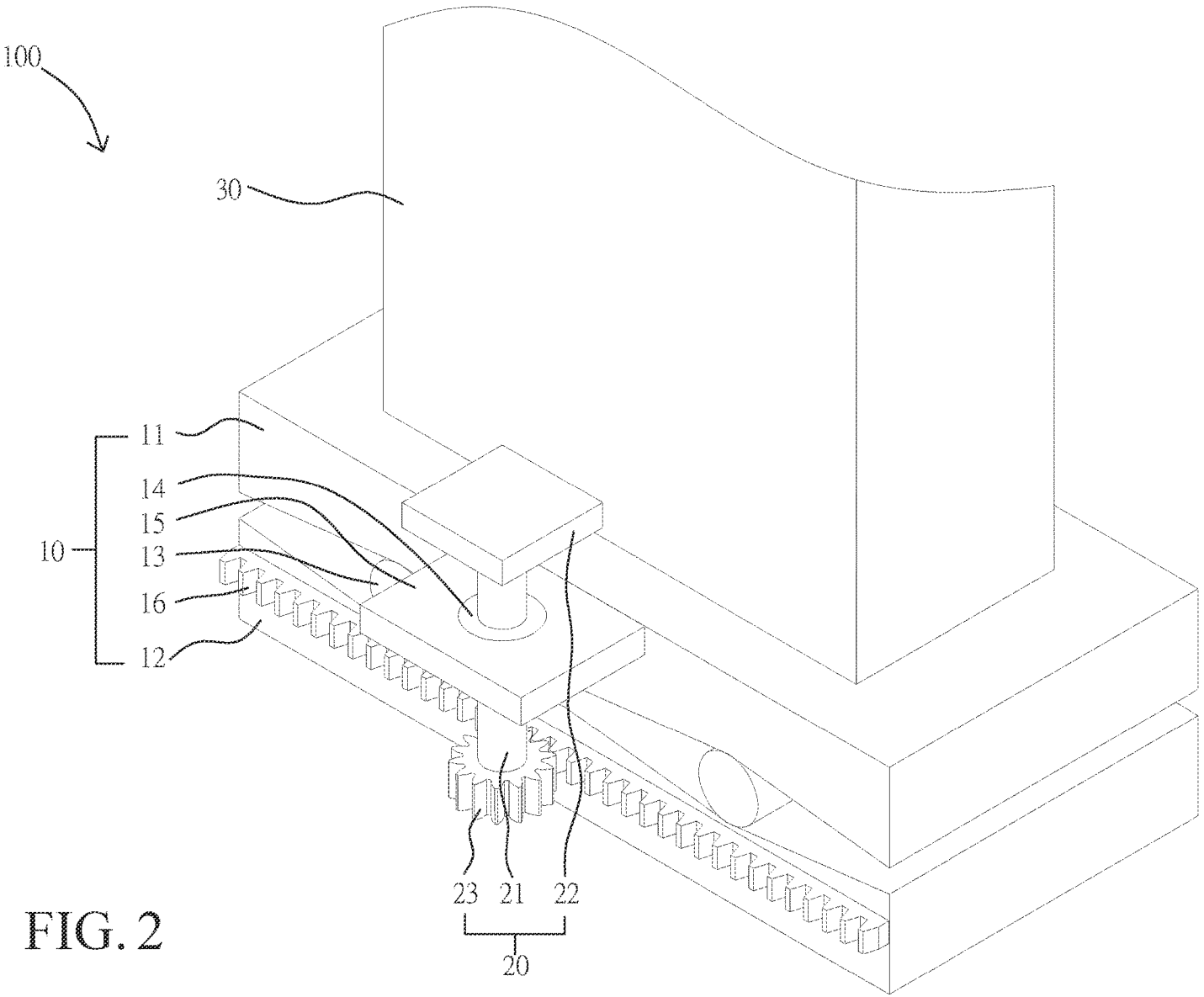
FIG. 2 is a schematic diagram showing the stationary state of the first embodiment of the seismic isolation device according to the present invention.
Figure 3:
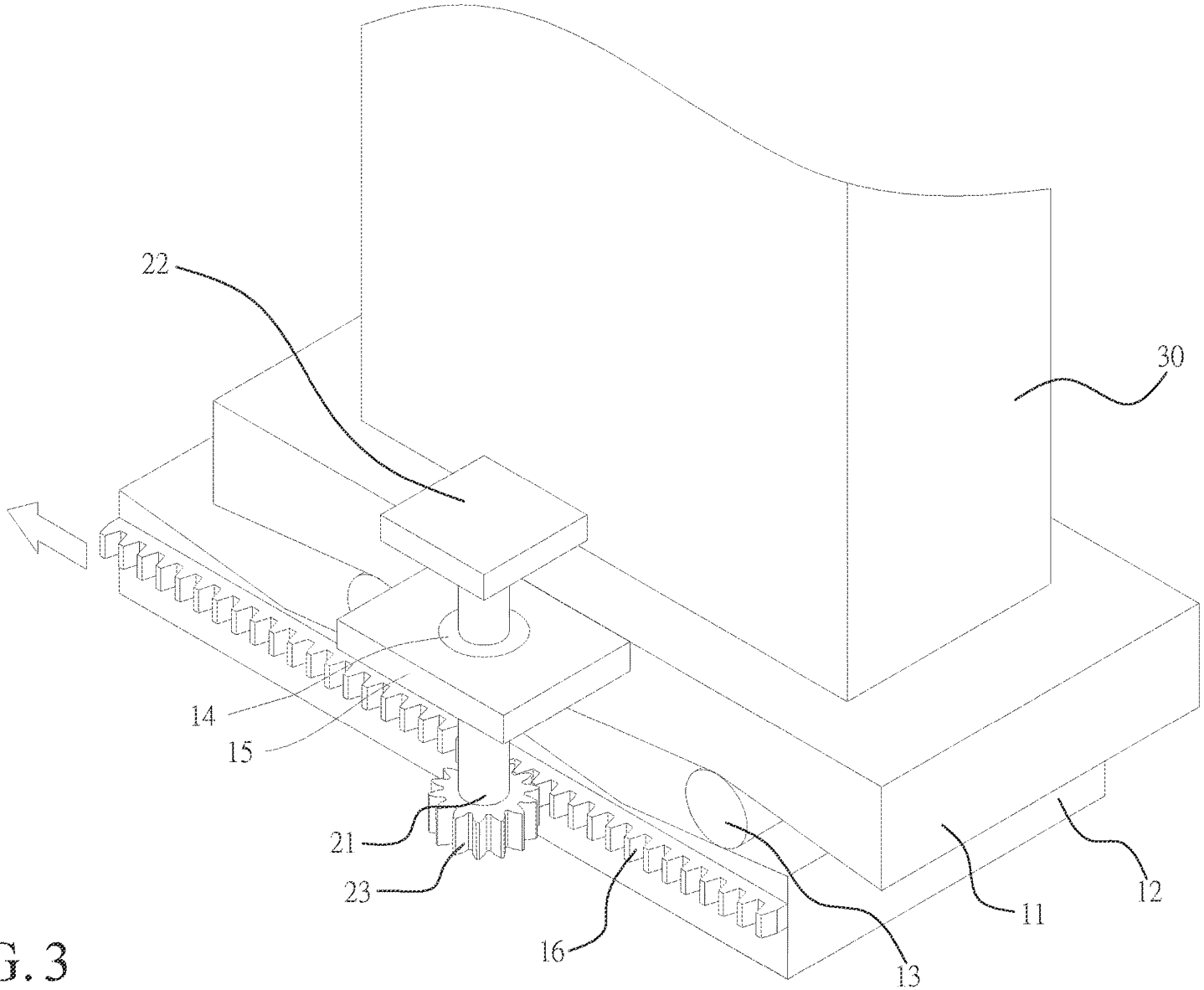
FIG. 3 is a schematic view showing the action state of the seismic isolation device during an earthquake according to the present invention.

FIG. 1 is an exploded view showing the three-dimensional structure of the first embodiment of the seismic isolation device according to the present invention. FIG. 2 is a schematic diagram showing the stationary state of the first embodiment of the seismic isolation device according to the present invention. FIG. 3 is a schematic view showing the action state of the seismic isolation device during an earthquake according to the present invention. As shown in the figures, the seismic isolation device 100 of the present invention includes an isolation support 10 for carrying an object 30, and an inerter unit 20 arranged at one side of the isolation support 10, so that the lateral force parallel to the ground surface results in the generation of the relative displacement in the isolating support 10 when an earthquake occurs, to drive the inerter unit 20 to provide an inertance. The details of the seismic isolation device of the present invention are as follows.

The isolation support 10 includes an upper plate 11, a lower plate 12, and at least one roller 13 located between the upper plate 11 and the lower plate 12. The lower plate 12 has an upper surface formed as a lower reset ditch 121. The roller rod 13 is arranged in the lower reset ditch 121. Furthermore, the upper plate 11 has a lower surface formed as an upper reset ditch 111 corresponding to the lower reset ditch 121. In one embodiment, the lower reset ditch 121 is a V-shaped ditch, and the upper reset ditch 111 is an upside down V-shaped ditch. Besides, the lower reset ditch 121 and the upper reset ditch 111 may also be semi-elliptical, etc., but the present invention does not limited to this. Accordingly, a limit space is formed between the upper reset ditch 111 and the lower reset ditch 121, and the roller 13 is arranged in the limit space. When an earthquake occurs, the lower plate 12 of the isolation support 10 is pushed by the lateral force parallel to the ground surface to make the lower plate 12 of the isolation support 10 laterally displaced to make the roller 13 roll, so that the upper plate 11 and the lower plate 12 have a relative displacement. In this embodiment, the number of the roller 13, the upper reset ditch 111 and the lower reset ditch 121 each may be set to two, but it is not limited to this.

The isolation support 10 further includes a bearing 14 for disposing the inerter unit 20, and a mounting bracket 15 for fixing the bearing 14 at the side of the upper plate 11. The inerter unit 20 may be rotatably arranged at the side of the isolation support 10 through the bearing 14 and the mounting bracket 15. In addition, the isolation support 10 includes a rack 16 disposed transversely on the side of the lower plate 12.

The inerter unit 20 includes a rotating rod 21 rotatably arranged at the side of the upper plate 11 through the bearing 14, and a flywheel 22 linked with an upper end of the rotating rod 21. A lower end of the rotating rod 21 extends downward to the lower plate 12. Specifically, the rotating rod 21 of the inerter unit 20 is installed into the bearing 14 of the isolation support 10, so that the rotating rod 21 may rotate smoothly through the bearing 14, thereby reducing the friction generated during the rotation. Therefore, it prevents the rotating rod 21 from rotating unsmoothly and causing the upper plate 11 and the lower plate 12 to be stuck or paused during the displacement process, so that the object 30 carried by the upper plate 11 avoids damage due to receiving uneven force. In addition, it can also be increased the service life of the inerter unit 20.

The lower end of the rotating rod 21 is connected with a pinion 23 corresponding to the rack 16 of the isolation support 10. The pinion 23 is in meshing contact with the rack 16 at the side of the lower plate 12. As shown in FIG. 3, when the lower plate 12 is moved under the lateral force, the rack 16 is moved with the lower plate 12 to drive the pinion 23 to make the rotating rod 21 rotate, thereby driving the flywheel 22 linked with the rotating rod 21. By way of driving the flywheel 22, the inertance is provided to greatly reduce the displacement reaction when a relative displacement is generated between the upper plate 11 and the lower plate 12 of the isolation support 10. Specifically, the inertance is the ratio of the inertial force generated by the inerter unit 20 to the relative acceleration between the upper plate 11 and the lower plate 12. Moreover, it can also avoid the problem of residual displacement after the earthquake due to excessive frictional damping during the displacement reaction.

Figure 4:
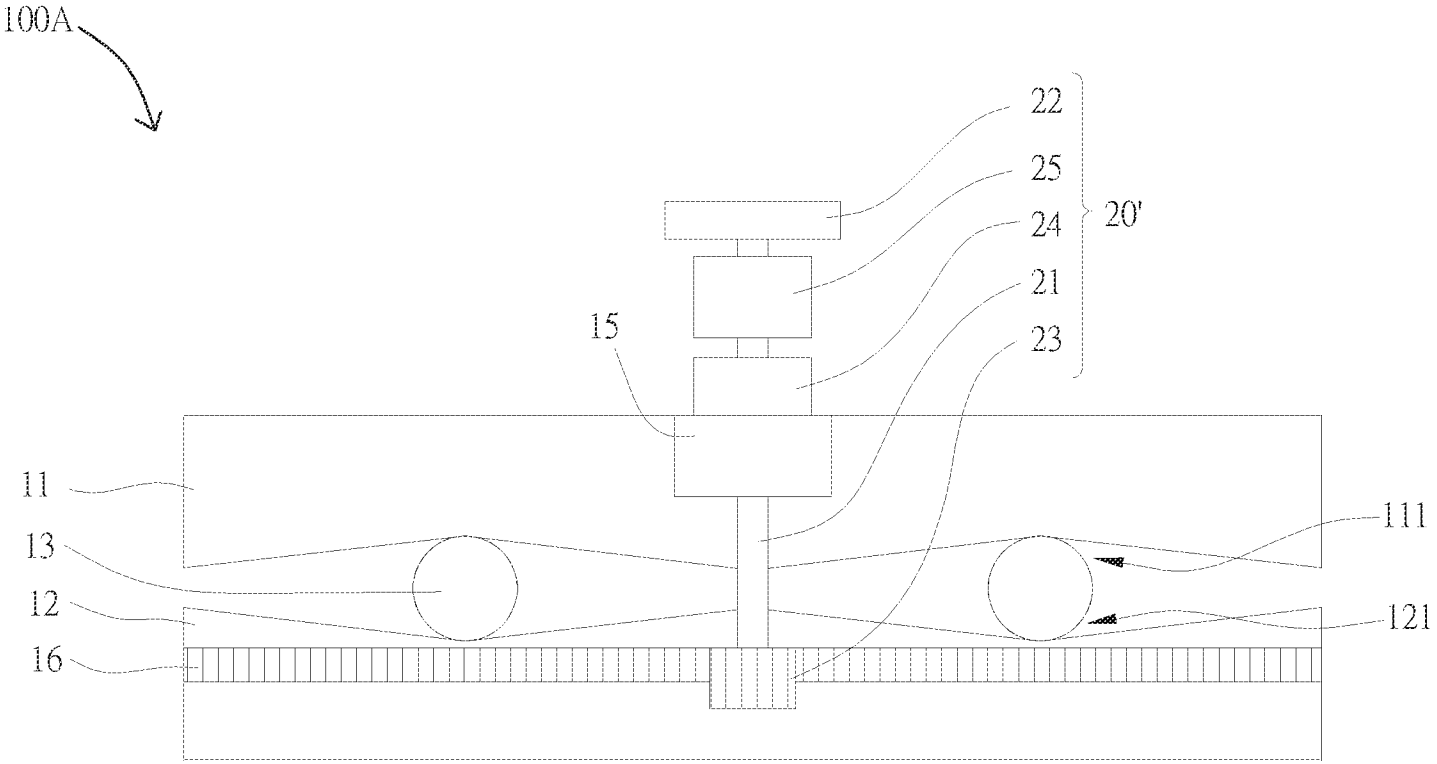
FIG. 4 is a schematic view showing the second embodiment of the seismic isolation device according to the present invention.

FIG. 4 is a schematic view showing the second embodiment of the seismic isolation device according to the present invention. The structure of the seismic isolation device 100A of the embodiment is roughly the same as that of the first embodiment. The difference is that the inerter unit 20' includes a gear assembly 24 and an electromagnetic damper 25. The same technical content will not be repeated here. The detailed differences are as follows.

The gear assembly 24 may be fixed on the upper plate 11, for example, at a side of the upper plate 11. The flywheel 22 connected with the upper end of the rotating rod 21 is linked with the gear assembly 24 through the rotating rod 21. In this embodiment, the gear assembly 24 may be a set of transmission gear or a speed-change gear, such as a gearbox, with the function of changing the rotation speed transmitted from the pinion 23 through the rotating rod 21 to the flywheel 22, but the present invention is not limited to this. When there is a horizontally relative displacement between the upper plate 11 and the lower plate 12, the rack 16 of the lower plate 12 drives the pinion 23 to rotate the rotating rod 21, and the gear assembly 24 may amplify the rotational speed of the rotating rod 21 so that the rotating speed of the flywheel 22 is also enlarged, for example, it can be enlarged several times or tens of times. This causes the flywheel 22 to rotate at a high speed even if the horizontally relative displacement between the upper plate 11 and the lower plate 12 is very small. In this way, a system formed by the flywheel 22 with small and slight mass blocks can provide a large inertance when the upper plate 11 and the lower plate 12 are relatively displaced, thereby reducing the displacement reaction between the upper plate 11 and the lower plate 12, to avoid the collision problem caused by the excessive displacement between the upper plate 11 and the lower plate 12, and to prevent the objects carried by the seismic isolation device 100A from damage due to the collision problem.

The electromagnetic damper 25 is linked with the gear assembly 24. Specifically, the electromagnetic damper 25 may be a motor for power generation. In other words, the electromagnetic damper 25 is arranged between the flywheel 22 and the gear assembly 24 to dissipate the energy generated from the rotation, and to reduce the maximum displacement reaction of the isolation support 10, so as to improve the problem of residual displacement after the earthquake due to excessive friction damping. Therefore, the present invention can protect the isolation support 10 from the impact of collision. Furthermore, since the electromagnetic damper 25 of the inerter unit 20' has function as power generation, a part of the rotational kinetic energy of the inerter unit 20' can be converted into electrical energy.

To sum up, the present invention provides the inerter unit 20 or 20' arranged at the side of the upper plate 11 and the lower plate 12 of the isolation support 10, so that when the upper plate 11 and the lower plate 12 are relatively moved, the inerter unit 20 or 20' may provide the inertance. In this way, the present invention can prevent the maximum displacement reaction of the isolation support 10 from exceeding its design range and collision when subject to a large earthquake. Namely that the present invention provides the inertance by the inerter unit 20 or 20' to reduce the maximum displacement reaction of the isolation support 10. It can also ensure that the response of the isolation support 10 to the acceleration generated by the earthquake is not excessive. In other words, the present invention increases the inerter units 20, 20' to provide the inertance for increasing proportionally the inertial force, so as to reduce the impact of acceleration on the isolation support 10 when the isolation support 10 is affected by acceleration or generates the relative displacement between the upper plate 11 and the lower plate 12 thereof. In addition, due to the arrangement of the inerter units 20, 20' in the present invention, when only a displacement is increased slightly, the flywheel can be quickly rotated to generate a large inertance. Therefore, the present invention can avoid the impact of the collision inside the isolation support 10 to achieve a better seismic isolation effect.

Figure 5:
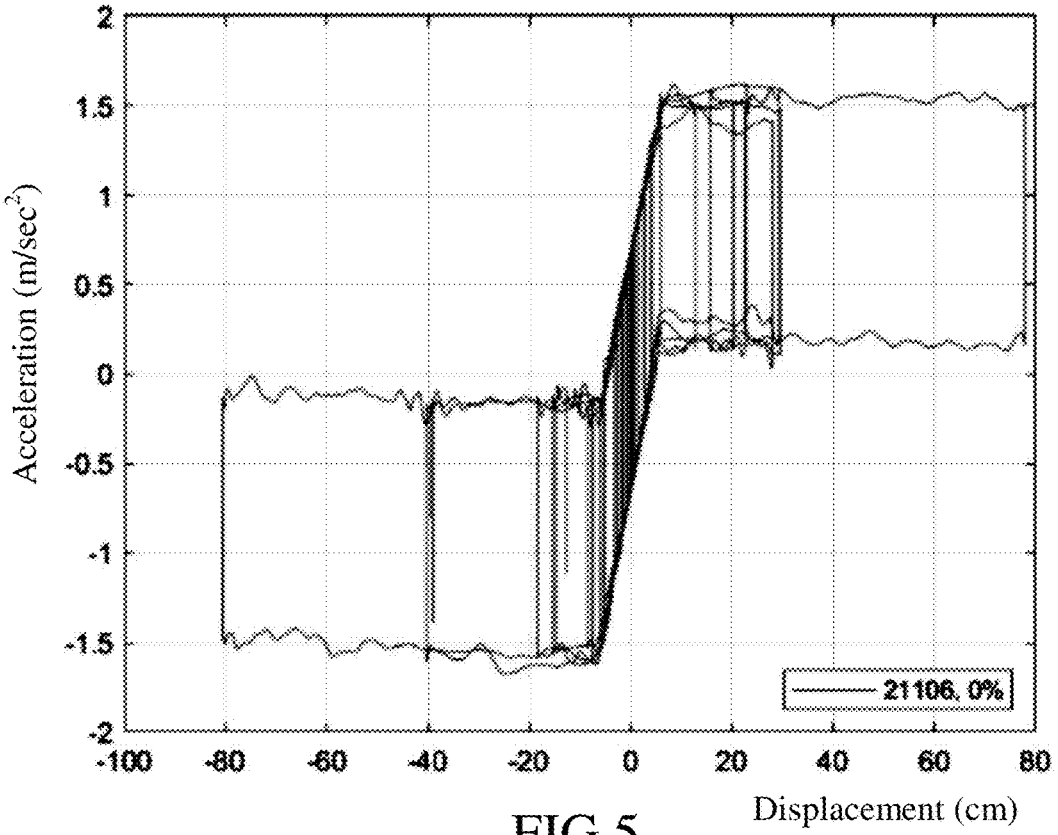
FIG. 5 is a schematic diagram showing the relationship between displacement and acceleration of the sloped rolling-type isolator according to the prior art.
Figure 6:
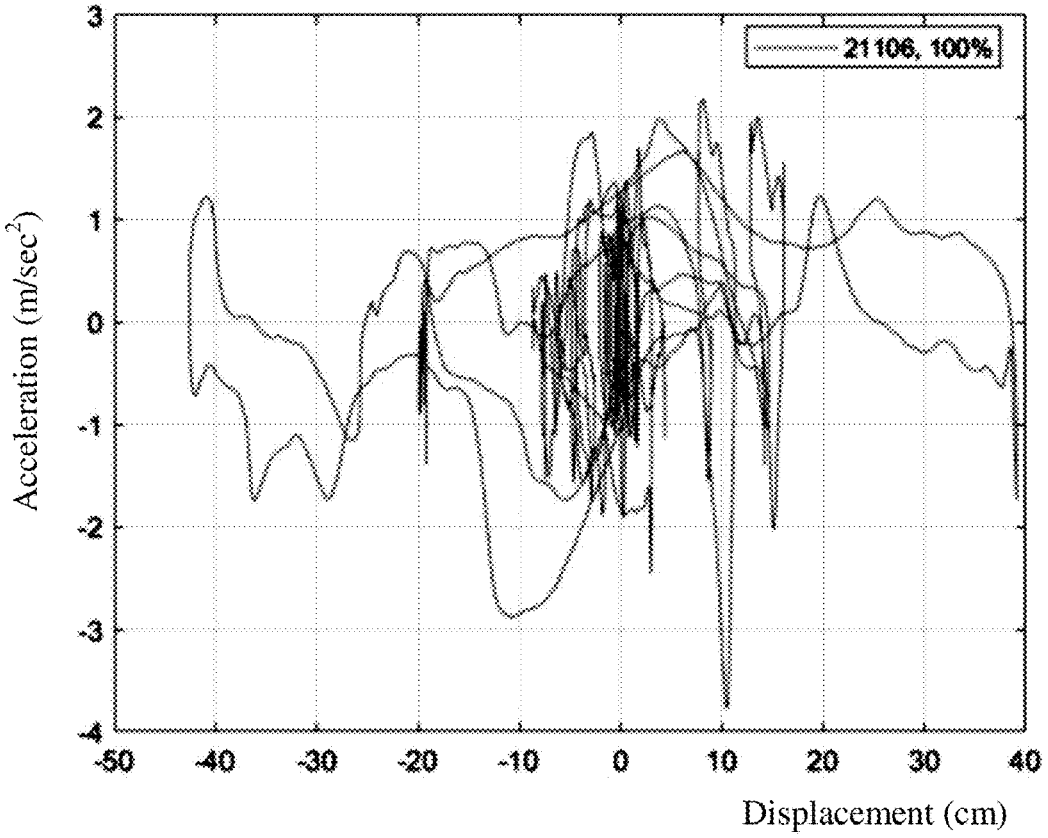
FIG. 6 is a schematic diagram showing the relationship between displacement and acceleration of the seismic isolation device according to the present invention.

Comparing FIG. 5 with FIG. 6, FIG. 5 shows that the maximum displacement of the conventional SRI in an earthquake exceeds 80 cm, while FIG. 6 shows that the maximum displacement of the present invention in the same earthquake is only 40 cm. It proves that the present invention has a better seismic isolation effect than the conventional SRI.

Figure 7:
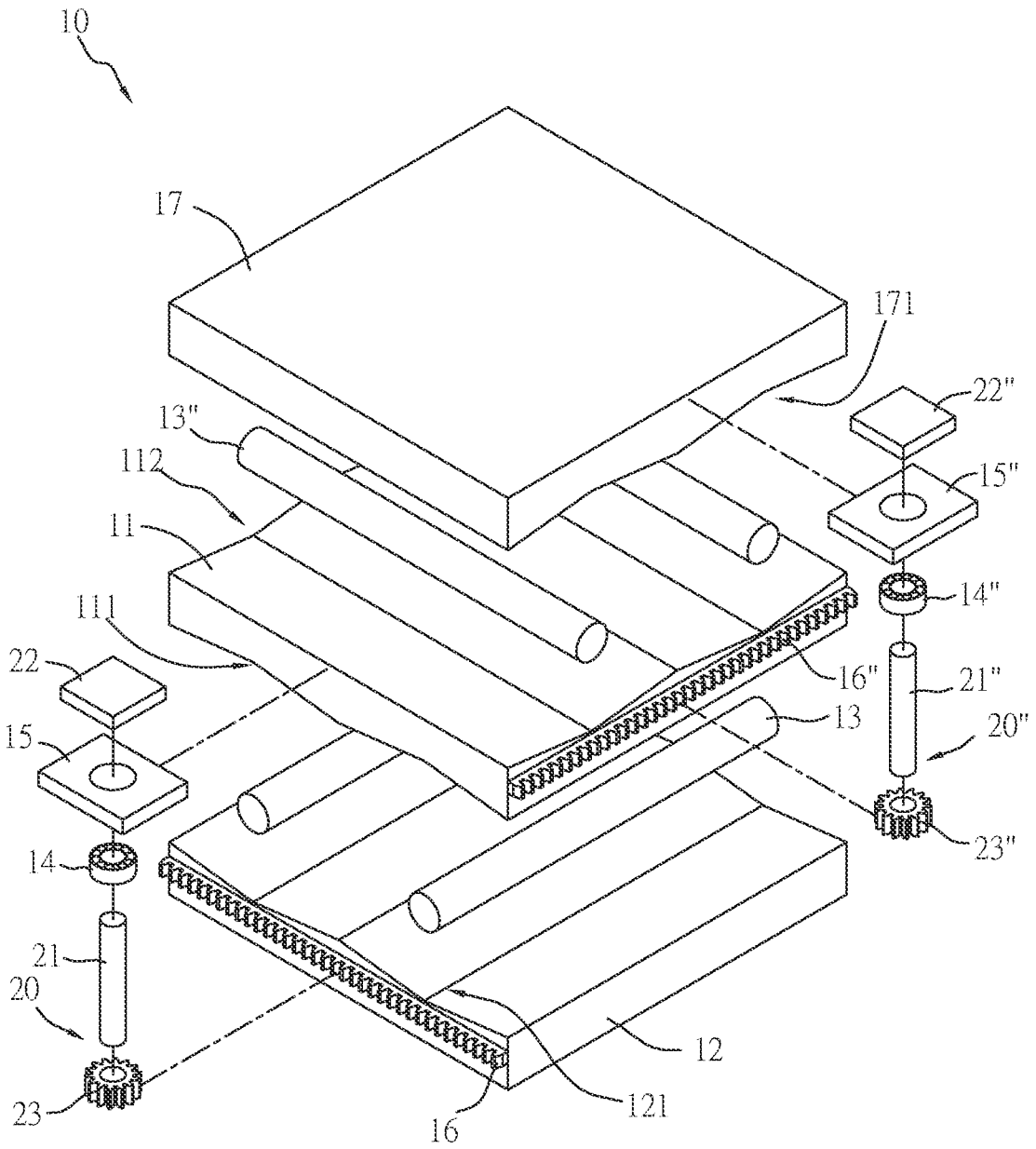
FIG. 7 is an exploded view showing the three-dimensional structure of the third embodiment of the seismic isolation device according to the present invention.

FIG. 7 is an exploded view showing the three-dimensional structure of the third embodiment of the seismic isolation device according to the present invention. The structure of the embodiment is roughly the same as that of the first embodiment. The difference is that the isolation support 10 further includes a top plate 17, at least one additional roller 13" and another inerter unit 20". The rest of the technical content that is the same as the first embodiment will not be repeated here. Details of the differences are as follows.

In the embodiment, the top plate 17 is disposed above the upper plate 11, and the top plate 17 has at least one upper reset ditch 171 facing toward the upper plate 11. The upper plate 11 has at least a lower reset ditch 112 in a one surface facing toward the upper reset ditch 171, and an upper reset ditch 111 back to the lower reset ditch 112 and facing toward the lower reset ditch 121. Note that the extension direction of the lower reset ditch 112 is different from that of the upper reset ditch 111, for example, the two extension directions differ by 90 degrees. At least one roller 13" can be provided between the upper reset ditch 171 of the top plate 17 and the lower reset ditch 112 of the upper plate 11.

In addition, in the embodiment, another inerter unit 20" is disposed at one side of the top plate 17 and the upper plate 11. Because the extension directions of the lower reset ditch 112 and the upper reset ditch 111 are different, the inerter unit 20", rotating rod 21", flywheel 22", pinion 23", bearing 14", mounting bracket 15" and rack 16" are disposed at a first side portion of the upper plate 11 and arranged at one side of the top plate 17, but the inerter unit 20, rotating rod 21, the flywheel 22, the pinion 23, the bearing 14, the mounting bracket 15 and the rack 16 are disposed at a second side portion of the upper plate 11 and arranged at one side of the lower plate 12. The first side portion is different from the second side portion, for example, the two different side portions are arranged at 90 degrees adjacent to each other. In this way, when the top plate 17 and the upper plate 11 move relative to each other, the inerter unit 20" can provide another inertance to reduce the displacement reaction. The relative movement direction of the top plate 17 and the upper plate 11 is different from that of the top plate 11 and the lower plate 12. Therefore, compared with the first embodiment, which can only reduce the response degree of the relative displacement in a single direction, this embodiment can further reduce the response degree of the relative displacement in different directions, to provides a better seismic isolation effect. The above is illustrated by taking the combination of two inerter units, the upper plate, the lower plate and the top plate as an example, but the present invention is not limited to this. The present invention may also use more inerter units and corresponding isolation supports to reduce the response degree of relative displacement from multiple different directions at the same time. In addition, the number of the electromagnetic dampers and the gear assemblies may be increased in one embodiment according to different needs.

In an embodiment, the flywheel 22, 22" of the first, second or third embodiment may be changed to a flywheel 22A having a mechanism with varying inerter, so that the inerter unit 20, 20' or 20" becomes a variable inerter system 20A.

Figure 8A:
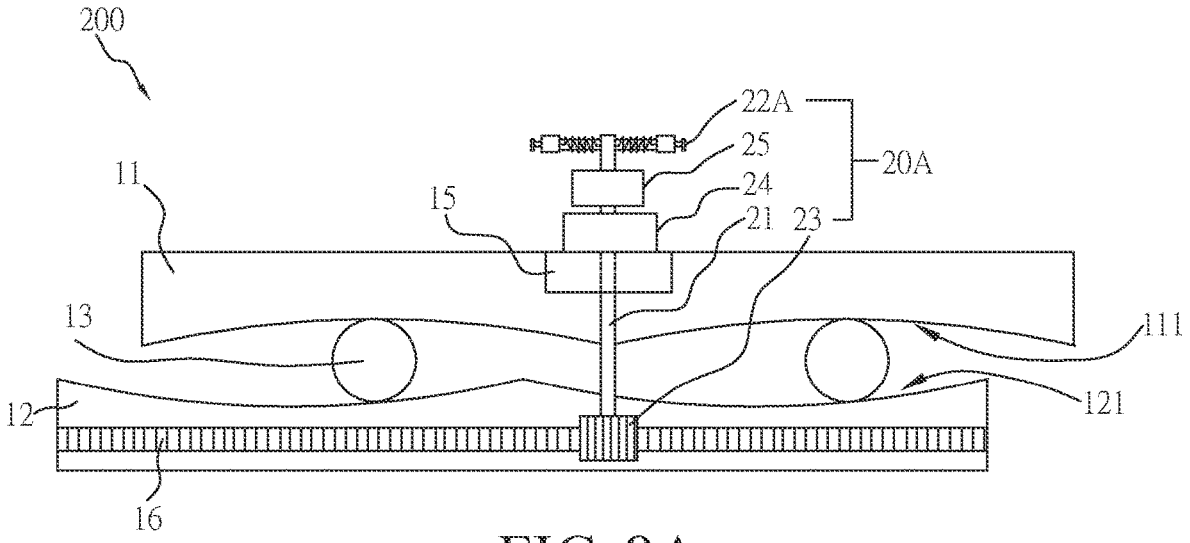
FIG. 8A is a schematic view showing the structure of the fourth embodiment of the seismic isolation device and its action state during an earthquake according to the present invention.
Figure 8B:
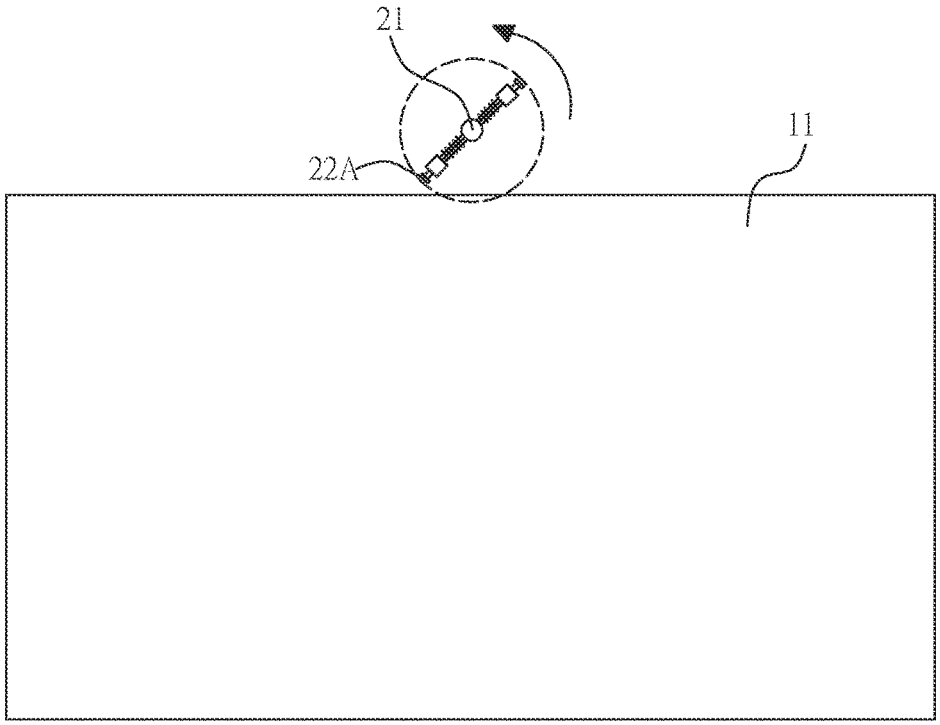
FIG. 8B is a schematic top view showing the structure of the fourth embodiment of the seismic isolation device according to the present invention.

FIG. 8A is a schematic view showing the structure of the fourth embodiment of the seismic isolation device and its action state during an earthquake according to the present invention. FIG. 8B is a top view of FIG. 8A. In the embodiment, the flywheel 22 of the second embodiment is changed to a flywheel 22A having a mechanism with varying inerter, so that the inerter unit 20' becomes a variable inerter system 20A. The variable inerter system 20A is installed at the side of the isolation support 10 to form a seismic isolation device that is a novel tuned mass damper with varying inerter 200 (hereinafter referred to TMDVI). The rest of the technical content that is the same as the second embodiment will not be repeated here. In addition, the flywheels 22 and 22" of the first and third embodiments described above may also be replaced with the flywheel 22A having a mechanism with varying inerter.

Figure 9A:
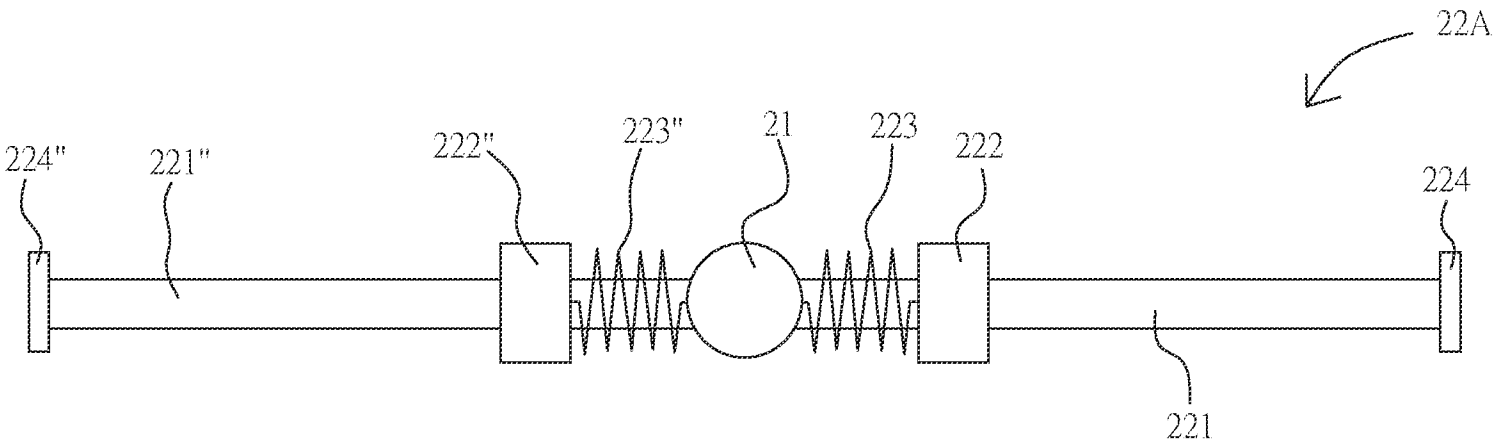
FIG. 9A is a schematic top view showing a mechanism with varying inerter in a low-speed state.
Figure 9B:
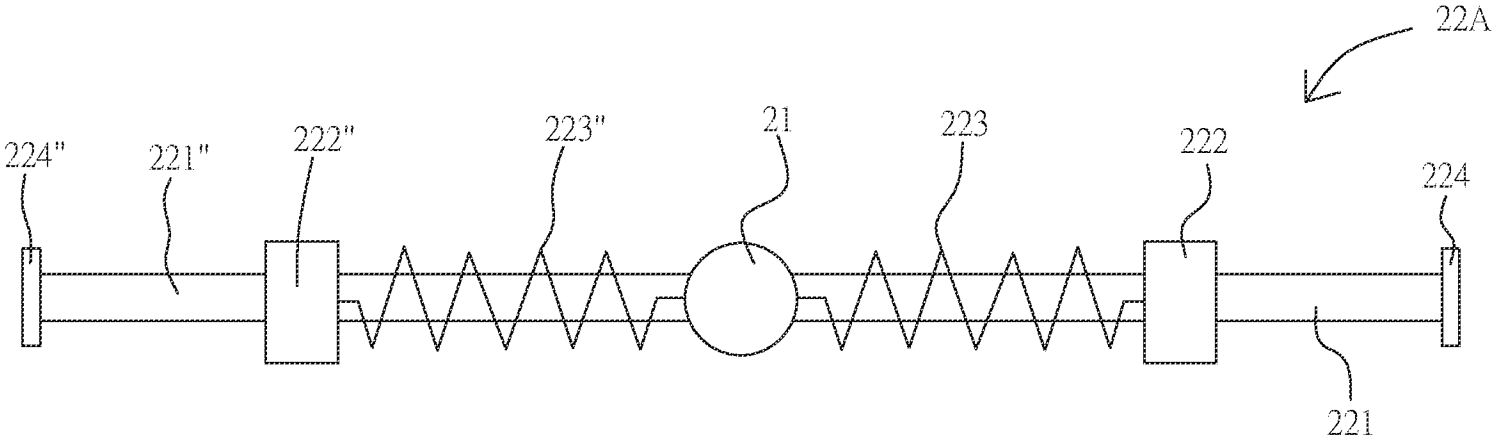
FIG. 9B is a schematic top view showing the mechanism with varying inerter in a high-speed state.

FIG. 9A is a top view showing the flywheel 22A having the mechanism with varying inerter in a low-speed state. FIG. 9B is a top view showing the flywheel 22A having the mechanism with varying inerter in a high-speed state. The mechanism with varying inerter of the flywheel 22A includes two guide rods 221, 221", two mass blocks 222, 222", and two springs 223, 223". Each of the guide rods 221, 221" has one end fixed to the rotating rod 21, and the other end having a baffle 224, 224". Each of the guide rods 221, 221" passes through one of the springs 223, 223" and one of the mass blocks 222, 222" correspondingly, so that two springs 223, 223" are respectively sleeved on the outer surfaces of the two guide rods 221, 221". Each of the springs 223, 223" has one end connected to one of the mass blocks 222, 222" correspondingly, and the other end selectively fixed on the rotating rod 21 or the baffle 224 or 224". In this way, the maximum deformation of the springs 223, 223" is limited to the distance between the rotating rod 21 and each of the baffles 224, 224"; and the furthest distance between the rotating rod 21 and each of the mass blocks 222, 222" is also limited.

Accordingly, when the rotating rod 21 rotates at a lower speed, the mass blocks 222, 222" will approach the rotating rod 21 and then the less inertance is provided. When the rotating rod 21 rotates at a faster speed, the mass blocks 222, 222" will move away from the rotating rod 21 and then the inertance will be greatly increased, so as to greatly reduce the speed reaction and displacement reaction. After that, because the rotating speed reduces, the mass blocks 222, 222" will rely on the elastic force of the springs 223, 223" to return to the position close to the rotating rod 21. In this way, the inertance becomes less again to avoid the excessive acceleration reaction. The above is an example of the combination of two guide rods 221, 221", two mass blocks 222, 222" and two springs 223, 223", but it is not intended to limit the number of guide rods, mass blocks and springs.

Figure 10:
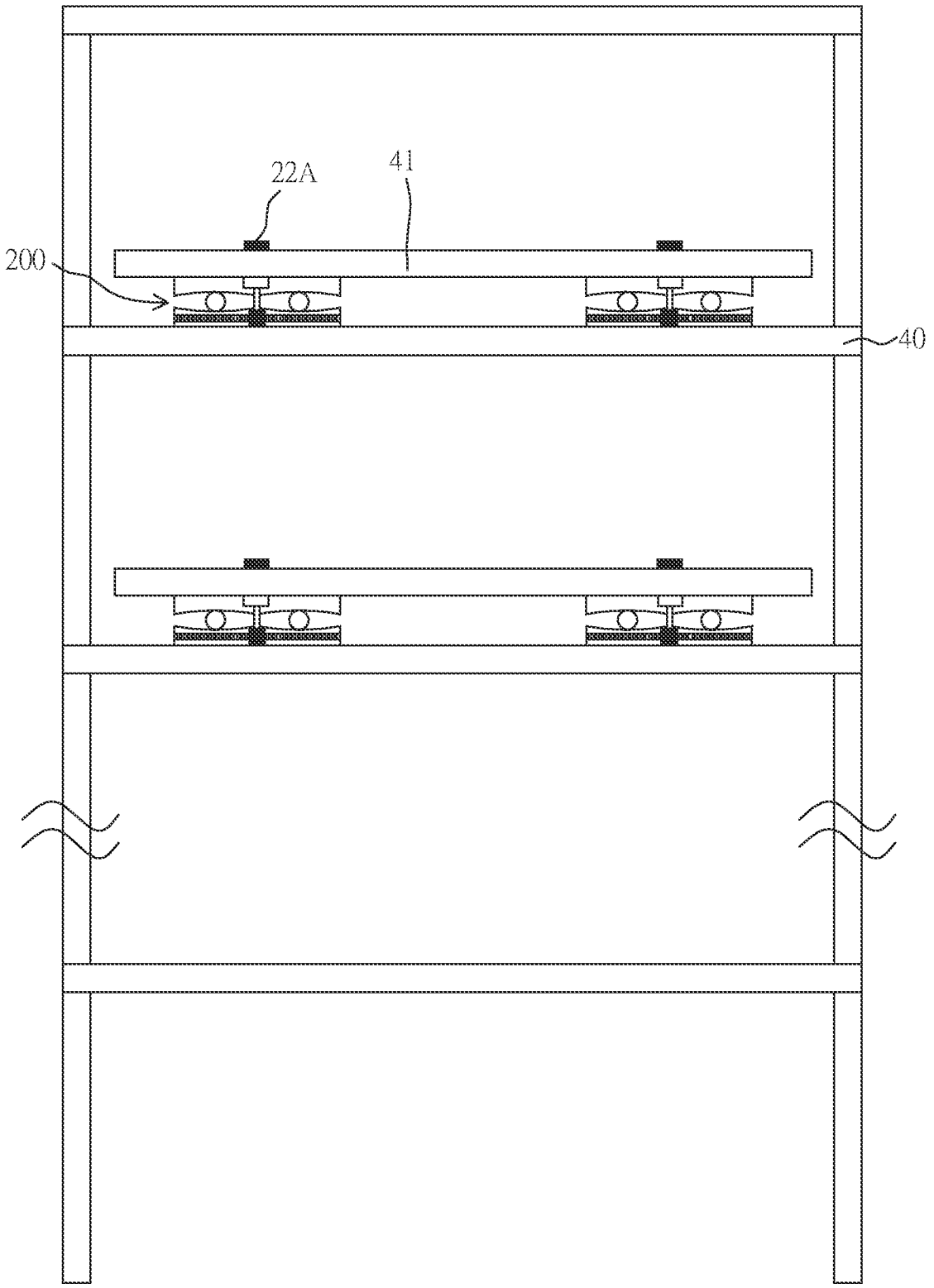
FIG. 10 is a schematic diagram showing the structure of a seismic isolation floor formed by installing the seismic isolation device of the present invention on a floor slab of a building.

FIG. 10 shows the structure of a seismic isolation floor formed by installing the TMDVI 200 on a floor slab of a building. Because the TMDVI 200 of the present invention employs a mechanism with varying inerter to replace the huge and heavy mass block in the traditional TMD, so that the inertance is greatly increased as the response of the TMDVI 200 is larger, thereby greatly reducing the displacement and speed reactions of the TMDVI 200. By way of this, the acceleration reaction of the seismic isolation floor is still maintained less than less than that of no installation of the TMDVI 200. Therefore, the lower plate 12 of the isolation support 10 of the TMDVI 200 may be disposed on the floor slab 40 of the main structure of the building, and an elevated floor 41 may be disposed on the upper surface of the upper plate 11 of the isolation support 10. Both the TMDVI 200 and the elevated floor 41 form a seismic isolation floor, which can also be called a tuned mass damping floor. The seismic isolation floor can be installed in different locations or different floors according to different requirements, such as reducing rotation and avoiding the detuning effect resulting from the slight difference between the vibration period of the seismic isolation floor and that of the main building structure.

Comparing the traditional TMD with the present invention, the traditional TMD must occupy a large amount of space in the building. For example, the damper in Taipei 101 building occupies the space of 5 floors thereof. Whether it is to place a single huge and heavy mass block or several scattered smaller mass blocks in the traditional TMD, it is necessary to achieve sufficient total mass, so it is inevitable that space will be wasted. Moreover, because the vibration response of the mass block of the traditional TMD must be large, it is difficult to install an elevated floor on the traditional TMD. Otherwise, there will be too large reaction above the elevated floor to be comfortable for users.

Figure 11A:
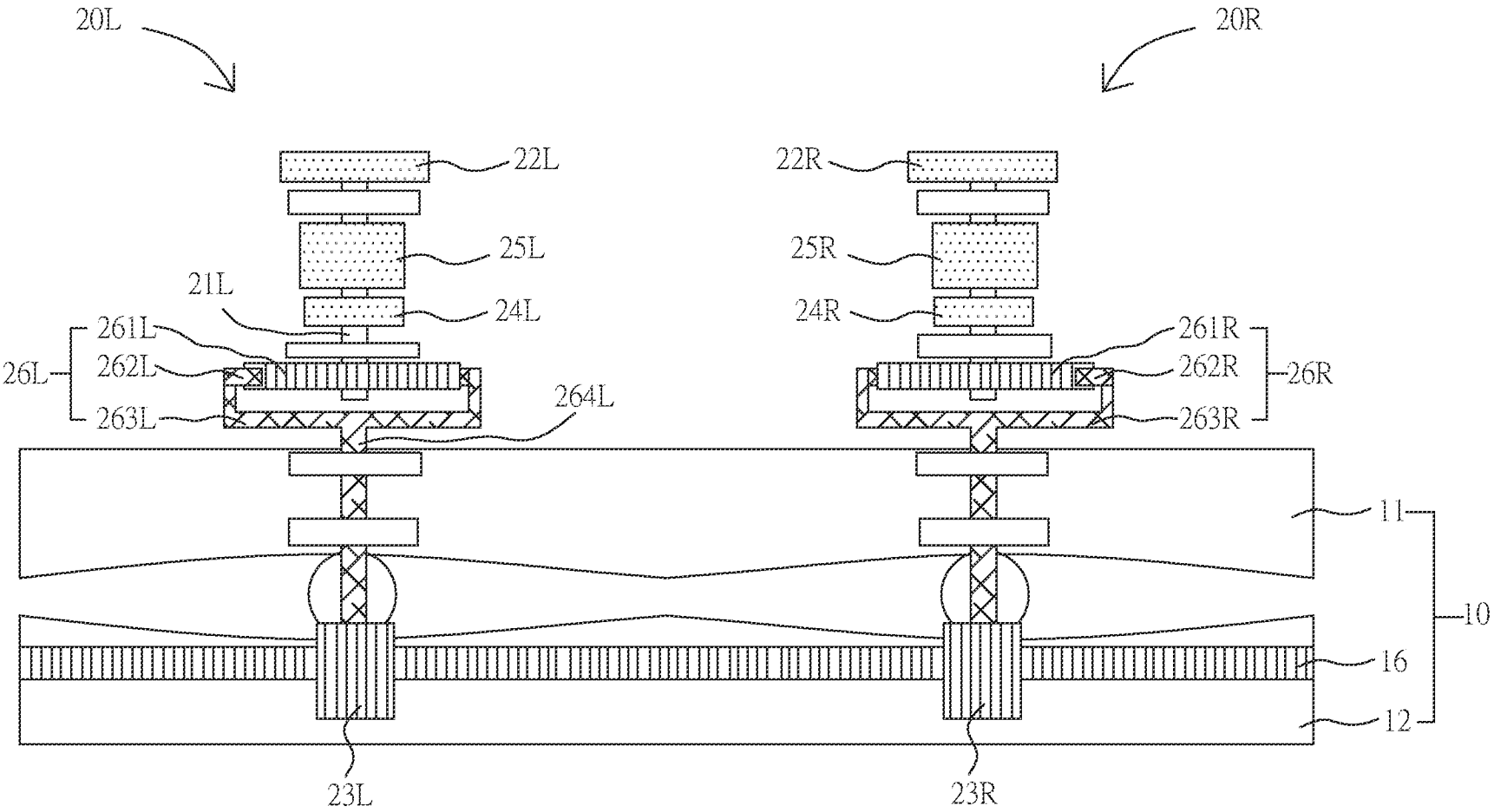
FIG. 11A is a schematic side view showing the structure of a seismic isolation device with a clutch according to the present invention.

In the above embodiments, two or more flywheels may be arranged on the same side of the isolation support 10, and when the upper plate 11 of the isolation support 10 is displaced in different directions, different flywheels are driven to rotate in different directions, respectively. As shown in FIG. 11A, two inerter units 20L and 20R are disposed on the same side of the isolation support 10. Inerter units 20L/20R not only have flywheels 22L/22R, motors 25L/25R, gearboxes 24L/24R, but also have clutches 26L/26R under the gearboxes 24L/24R, respectively. The clutches 26L/26R respectively include ratchet wheels 261L/261R, pawls 262L/262R, and rotating bases 263L/263R. Taking the clutch 26L on the left as an example, the ratchet wheel 261L is a flywheel with a ratchet-shaped edge; one end of the pawl 262L is connected to the rotating base 263L, and the other end is clamped to the ratchet-shaped edge of the ratchet wheel 261L. The rotating base 263L includes a rotating shaft 264L. The rotating shaft 264L is fixed on the side of the upper plate 11 and is rotatably connected to the pinion 23L; the ratchet wheel 261L is connected to the flywheel 22L, the motor 25L and the gearbox 24L in series through the rotating rod 21L. It should be noted that there is no direct connection between the rotating rod 21L and the rotating shaft 264L.

Figure 11B:
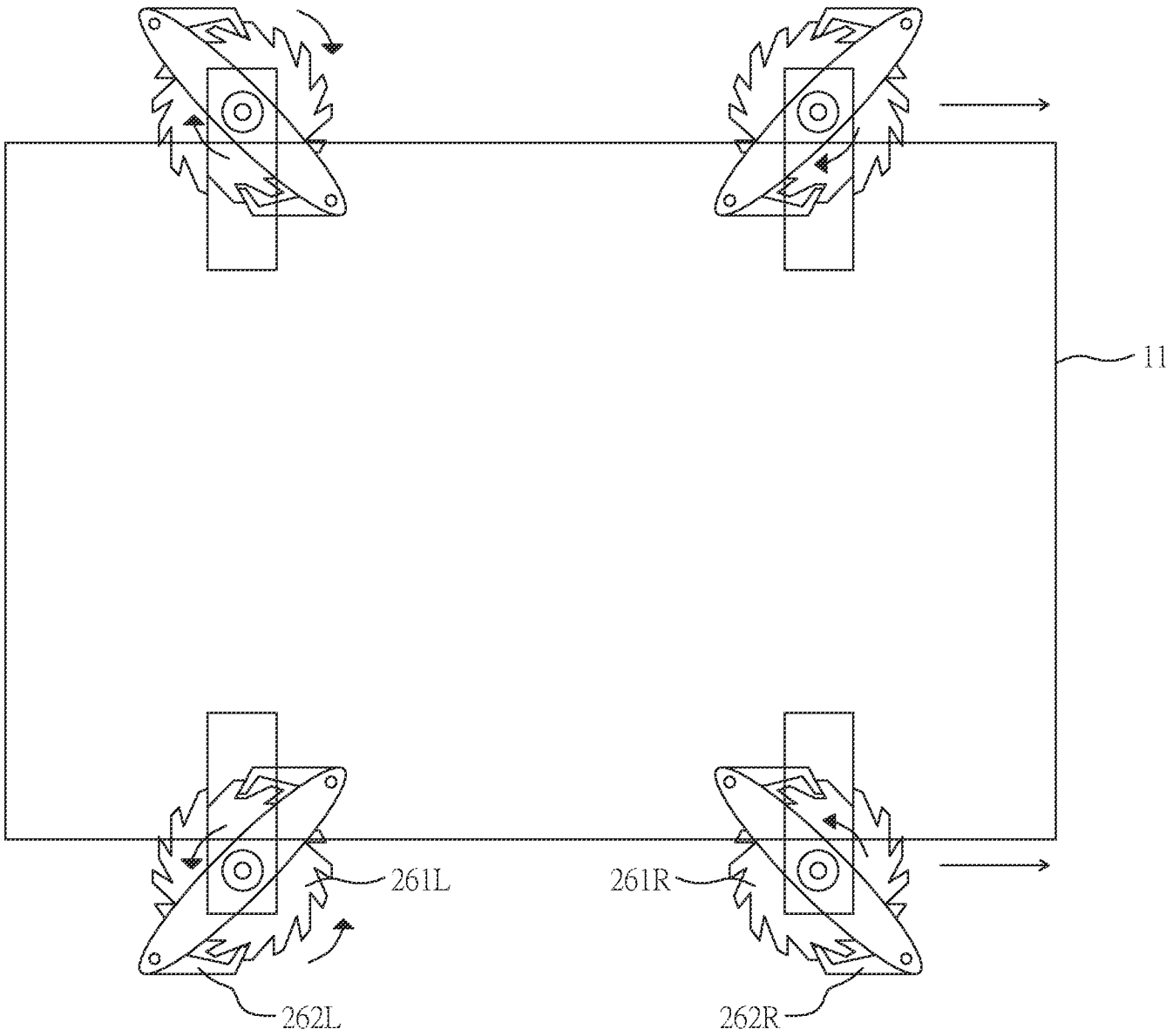
FIG. 11B is a schematic top view showing the clutch and the action relationship between the ratchet wheels and pawls thereof and the upper plate according to the present invention.

FIG. 11B omits components such as the flywheels 22L/22R, the motors 25L/25R, and the gearboxes 24L/24R, and only focuses on drawing the action relationship between the ratchet wheels 261L/261R, the pawls 262L/262R and the upper plate 11. According to the arrangement of the ratchet wheels 261L/261R and the pawls 262L/262R in FIG. 11B, the pawl 262L of the clutch 26L on the left can only apply force to the ratchet wheel 261L in the counterclockwise direction; while the pawl 262R of the clutch 26R on the right can only apply force to the ratchet wheel 261R in the clockwise direction.

Referring to FIGS. 11A and 11B, when the upper plate 11 moves to the right relative to the lower plate 12 and simultaneously drives the pinions 23L and 23R to rotate counterclockwise, the inerter unit 20L on the left first employs its pinion 23L to drive the rotating base 263L to rotate counterclockwise through the rotating shaft 264L of the clutch 26L. If the rotation speed of the ratchet wheel 261L is less than the rotation speed of the rotating base 263L with its pawl 262L in the same direction, the pawl 262L will apply force to the ratchet wheel 261L to rotate counterclockwise, thereby driving the flywheel 22L to rotate counterclockwise. However, when rotating counterclockwise, the pawl 262R of the clutch 26R on the right cannot apply force to the ratchet wheel 261R, so the right ratchet wheel 261R will not be driven. In other words, when the upper plate 11 moves to the right relative to the lower plate 12, although the pinion 23R on the right may drive the rotating base 263R of the clutch 26R to rotate counterclockwise, the rotating base 263R cannot further drive the ratchet wheel 261R on the right to rotate.

Similarly, when the upper plate 11 moves to the left relative to the lower plate 12, the ratchet wheel 261R on the right may be driven by its pawl 262R, thereby driving the flywheel 22R on the right to rotate clockwise, but the flywheel 22L on the left does not be driven and is still stationary. In this way, The rotational kinetic energy of the driven flywheel 22L (or 22R) will be dissipated because it is used to push the motor 25L (or 25R) to rotate to generate electrical energy, and then the damping force provided by the motor 25L (or 25R) increases with the rotation speed. For each different moving direction, only one of the flywheels 22L and 22R may be forced to rotate while providing a reaction force to a building structure through the isolation support 10, which may effectively reduce the response of the building structure.

In other embodiments, the aforementioned clutches 26L/26R with ratchet-and-pawl type may be replaced by other types of clutches, such as roller clutches and formsprag overrunning clutches.

In one embodiment, the aforementioned variable inerter system may be installed inside a container filled with a viscous damping liquid to provide damping and make the damping increase as the inertance becomes larger.

In summary, compared with the prior art, the present invention has the following advantages:

1. Varying the inertance in stages to control the input of vibration with different scale by adjusting each spring to have a different maximum expansion length.

2. Replacing the single huge and heavy mass block with the inerter unit with small and light mass blocks, to solve the problem of the traditional TMD.

3. Balancing the acceleration reaction and displacement reaction to solve the problem of the traditional TMDI.

4. Greatly reducing the vibration reaction compared with the traditional TMD and the TMDVI, and suitable for installing under the elevated floor to form a tuned mass damping floor, to solve the problem of the traditional mass block occupying a huge space.

5. Adjusting slightly the vibration period of the seismic isolation floor to avoid the detuning effect.

The foregoing descriptions of the preferred embodiments of the present invention have been provided for the purposes of illustration and explanations. It is not intended to be exclusive or to confine the invention to the precise form or to the disclosed exemplary embodiments. Accordingly, the foregoing descriptions should be regarded as illustrative rather than restrictive. Obviously, many modifications and variations will be apparent to professionals skilled in the art. The embodiments are chosen and described in order to best explain the principles of the invention and its best mode for practical applications, thereby to enable persons skilled in the art to understand the invention for various embodiments and with various modifications as are suited to the particular use or implementation contemplated. It is intended that the scope of the invention be defined by the claims appended hereto and their equivalents in which all terms are meant in their broadest reasonable sense unless otherwise indicated. Therefore, the term "the invention", "the present invention" or the like is not necessary to confine the scope defined by the claims to a specific embodiment, and the reference to particularly preferred exemplary embodiments of the invention does not imply a limitation on the invention, and no such limitation is to be inferred. The invention is limited only by the spirit and scope of the appended claims. The abstract of the disclosure is provided to comply with the rules on the requirement of an abstract for the purpose of conducting survey on patent documents, and should not be used to interpret or limit the scope or meaning of the claims. Any advantages and benefits described hereto may not apply to all embodiments of the invention. It should be appreciated that variations may be made in the embodiments described by persons skilled in the art without departing from the scope of the present invention as defined by the following claims. Moreover, no element and component in the present disclosure is intended to be dedicated to the public regardless of whether the element or component is explicitly recited in the following claims.

What is claimed is:

1. A seismic isolation device comprising:

an isolation support, comprising an upper plate, a lower plate, and at least one roller located between the upper plate and the lower plate, wherein the lower plate comprises an upper surface with a lower reset ditch, and the upper plate comprises a lower surface with an upper reset ditch corresponding to the lower reset ditch, wherein the at least one roller is located between the upper reset ditch and the lower reset ditch; and an inerter unit, comprising a rotating rod and a flywheel, wherein the rotating rod is arranged on a side of the upper plate and has an upper end and a lower end, wherein the lower end of the rotating rod extends to a side of the lower plate, and the upper end of the rotating rod is linked with the flywheel, and wherein the inerter unit provides an inertance to reduce a displacement reaction resulting from relative displacement between the upper plate and the lower plate.

2. The seismic isolation device according to claim 1, wherein the inerter unit comprises a pinion disposed at the lower end of the rotating rod, and the isolation support comprises a rack disposed at the side of the lower plate to mesh with the pinion.

3. The seismic isolation device according to claim 1, wherein the isolation support comprises a bearing disposed at the side of the upper plate, and a mounting bracket for fixing the bearing to the side of the upper plate, wherein the rotating rod penetrates the bearing.

4. The seismic isolation device according to claim 1, wherein the inerter unit comprises a gear assembly and an electromagnetic damper, the gear assembly is linked with the electromagnetic damper through the rotating rod, and the electromagnetic damper is linked with the flywheel through the rotating rod.

5. The seismic isolation device according to claim 4, wherein the gear assembly is a speed-change gear, and the electromagnetic damper is a motor for power generation.

6. The seismic isolation device according to claim 1, wherein the lower reset ditch is a V-shaped ditch, and the upper reset ditch is an upside down V-shaped ditch.

7. The seismic isolation device according to claim 1, wherein the isolation support comprises a top plate disposed on the upper plate, and at least one second roller disposed between the top plate and the upper plate.

8. The seismic isolation device according to claim 7, further comprising a second inerter unit disposed on a second side of the upper plate together with a side of the top plate, to provide a second inertance to reduce a displacement reaction resulted from relative displacement between the top plate and the upper plate, wherein the relative displacement between the top plate and the upper plate has a direction different from that of the relative displacement between the upper plate and the lower plate.

9. The seismic isolation device according to claim 1, wherein the flywheel has a mechanism with a varying inerter, and the mechanism with the varying inerter provides different magnitudes of the inertance as the rotation speed of the rotating rod changes.

10. The seismic isolation device according to claim 9, wherein the mechanism with varying inerter includes two guide rods, two mass blocks and two springs, each of the two guide rods has one end fixed to the rotating rod, the two springs are respectively sleeved on the two guide rods, the two guide rods respectively pass through the two mass blocks, and each of the two mass blocks is correspondingly connected to each of the two springs.

11. The seismic isolation device according to claim 10, wherein each of the two guide rods has another end having a baffle, and each of the two springs has one end selectively fixed to one of the rotating rod and the baffle.

12. The seismic isolation device according to claim 10, wherein the lower plate of the isolation support is disposed on a floor slab of a building, and the upper plate has an upper surface to dispose an elevated floor thereon.

13. The seismic isolation device according to claim 1, wherein a number of the inerter unit is at least two, including a first inerter unit and a second inerter unit, both of which are arranged on a same side of the isolation support, wherein the first inerter unit includes a first clutch and a first flywheel, and the second inerter unit includes a second clutch and a second flywheel, wherein when the upper plate moves in a first direction relative to the lower plate, the first clutch drives the first flywheel to rotate counterclockwise while the second flywheel is stationary, and wherein when the upper plate moves in a second direction relative to the lower plate, the second clutch drives the second flywheel to rotate clockwise while the first flywheel is stationary.

* * * * *